US005959512A

United States Patent [19]

Sherman

[11] Patent Number: 5,959,512

[45] Date of Patent: Sep. 28, 1999

[54] ELECTRONICALLY TUNED VOLTAGE CONTROLLED EVANESCENT MODE WAVEGUIDE FILTER

[75] Inventor: James R. Sherman, St. Petersburg, Fla.

[73] Assignee: Raytheon Company, Lexington, Mass.

[21] Appl. No.: 08/934,339

[22] Filed: Sep. 19, 1997

[51] Int. Cl.[6] ..... H01P 1/202

[52] U.S. Cl. ..... 333/209; 333/210

[58] Field of Search ..... 333/208, 209, 333/210, 212, 231, 235

[56] References Cited

U.S. PATENT DOCUMENTS

| | | | |
|---|---|---|---|
| 3,509,499 | 4/1970 | Schaffner | 333/231 |
| 3,818,388 | 6/1974 | Hill et al. | 333/210 |
| 3,836,875 | 9/1974 | Duncan et al. | 333/231 |
| 3,919,666 | 11/1975 | Posner et al. | 331/96 |
| 4,077,039 | 2/1978 | Ren et al. | 343/786 |
| 4,156,861 | 5/1979 | DeMambro et al. | 333/250 |
| 4,380,747 | 4/1983 | Curtinot et al. | 333/202 |
| 4,417,220 | 11/1983 | Holyman et al. | 333/174 |
| 4,692,727 | 9/1987 | Wakino et al. | 333/219 |
| 4,694,466 | 9/1987 | Kadin | 331/179 |
| 4,746,883 | 5/1988 | Sauvage et al. | 333/206 |
| 5,065,453 | 11/1991 | Thomas | 455/286 |
| 5,107,233 | 4/1992 | Stoft | 333/168 |
| 5,184,097 | 2/1993 | Brouzes et al. | 333/202 |
| 5,459,123 | 10/1995 | Das | 333/212 X |

FOREIGN PATENT DOCUMENTS

| | | | |
|---|---|---|---|
| 64453 | 11/1982 | European Pat. Off. | 333/212 |

OTHER PUBLICATIONS

George F. Craven and C.K. Mok, "The Design of Evanescent Mode Waveguide Bandpass Filters for a Prescribed Insertion Loss Characteristic", *IEEE Transactions on Microwave Theory and Techniques*. vol. MTT–19, No. 3, Mar. 1971, pp. 295–308.

Chi–Yang Chang and Tatsuo Itoh, "Microwave Active Filters Based on Coupled Negative Resistance Method", *IEEE Transactions on Microwave Theory and Techniques*. vol. 38, No. 12, Dec. 1990, pp. 1879–1884.

Yong–Hui Shu, Julio A. Navarro, and Kai Chang, "Electronically Switchable and Tunable Coplanar Waveguide—Slotline Band–Pass Filters", *IEEE Transactions on Microwave Theory and Techniques*. vol. 39, No. 3, Mar. 1991, pp. 548–554.

A. Presser, "Varactor–Tunable, High–Q Microwave Filter", *RCA Review*, vol. 42, Dec. 1981, pp. 691–705.

*Primary Examiner*—Seungsook Ham
*Attorney, Agent, or Firm*—Baker & Botts, L.L.P.

[57] ABSTRACT

Tunable varactor diodes are utilized to adjust the filter frequency of a waveguide filter operating in evanescent mode. Because evanescent mode signals in a waveguide attenuate as they propagate, and because shunt capacitance between a waveguide and the surroundings can change the frequency at which the signals attenuate, controlling the shunt capacitance can filter the signals passing along the waveguide.

13 Claims, 3 Drawing Sheets

ELECTRONICALLY TUNED VOLTAGE CONTROLLED EVANESCENT MODE WAVEGUIDE FILTER

TECHNICAL FIELD

This invention relates to varactor-tuned filters, and more particularly to varactor-tuned filters for high-frequency applications.

BACKGROUND OF THE INVENTION

Current industrial and military applications often use Yttrium-Iron-Garnet (YIG) filters to tune circuits in high-frequency applications such as waveguide filters in microwave communications. The major drawback to this approach is the slow tuning speeds, 200 to 400 microseconds, due to the ferrite hysteresis of the magnetic tuning circuit. Also, the high magnetic fields require large, expensive and heavy magnetic field coils and complex high-current drivers.

Mechanically tuned capacitors, an alternative to the YIG filter, are implemented by inserting screws into a waveguide. Filters using mechanically tuned capacitors allow wide-range tuning of the filter's pass band. Unfortunately, screws physically inserted into the waveguide are seen by different frequencies to have widely different sizes. Because the screw size is seen differently by different frequencies, the pass band center frequency varies nonlinearly. Also, to tune a waveguide filter, the screws controlling the capacitance must be adjusted, a time-consuming mechanical process often requiring a remote controlled actuator. Such filters cannot be adjusted rapidly, since adjustment of the screws requires time and mechanical energy. As a result of the delays imposed by the mechanical tuning and as a result of the nonlinear relationship between center frequency and capacitance, electronic tuning commands generated by computers are difficult to implement effectively.

To satisfy high-speed tuning requirements, some designs now utilize varactors, which can be tuned at tuning-rates three orders of magnitude higher than those of the YIG. Because varactors take advantage of the voltage dependence of the capacitance across the charge separation in the depletion region of a p-n junction, varactors may be tuned in a capacitance range determined by the range of available voltages, from a reverse voltage of zero volts to breakdown. But varactors have very high losses, particularly at higher frequencies, which must be compensated. Active devices are available to compensate some of this loss, but only over a narrow tuning range. The negative resistance provided by an active element such as a MESFET or other high-Q Gallium-Arsenide active device, for example, can provide an impedance with the necessary negative real part, but at a cost of tuning range. In other words, although the varactor itself can be tuned over a range of voltages from zero to breakdown, the high-frequency losses limit the usefulness of varactor-tuned filters over narrow frequency ranges. Since tuning range varies with band, at high frequency bands another approach is needed if selectivity and tuning speed are not to be sacrificed.

SUMMARY OF THE INVENTION

The present invention overcomes the foregoing and other problems with a waveguide filter operating below cutoff over a wide range of frequencies and with high tuning speeds. The filter of the present invention includes varactors mounted in series with a waveguide to provide shunt capacitance, altering the frequency at which the waveguide filter passes signals along the waveguide. The center frequency of the passband of the waveguide depends on this shunt capacitance. The varactor is tuned by a bias voltage that may be changed very quickly, and as a result the center frequency of a varactor-tuned waveguide filter may "hop" from frequency to frequency much more quickly than filters tuned by other means. Bandwidths of varactor-tuned waveguide filters show little variation with frequency, and large signal suppression outside the passband may be realized. The bias voltage applied to the varactor is controlled by a computer via a digital to analog converter, or may be generated by other circuitry. Because the voltage applied to the varactor varies between zero and breakdown, the varactor capacitance varies over a wide range of values, giving the filter a wide tuning spectrum. Variable gain amplifiers are employed to linearize the amplitude response as the filter is tuned.

In one embodiment, a conductor inserted into a waveguide, and the surface of the waveguide supporting the conductor, are connected to one terminal of a varactor; the other terminal is connected to a circuit controlled by s software. A radio-frequency signal with a frequency below the cutoff frequency of the waveguide (that is, a signal in evanescent mode) passes between the conductor and the waveguide floor. The capacitance between the conductor and the waveguide floor, controlled by the varactor, shunts the signal. A plurality of such varactors are included and independently controlled. Also, the conductor may include a mechanically-adjusted screw thereby providing coarse tuning subject to further fine-tuning by the varactor.

The varactor-tuned waveguide filter overcomes other problems inherent in mechanically-tuned waveguides due to the simple relationship between voltage and capacitance in a varactor. This relationship is substantially independent of frequency, and is susceptible to tabulation or computation by simple hardware or software. Mechanically-tuned waveguide filters suffer from frequency-dependence of the capacitance between the adjustment screws and the waveguide walls.

Another advantage of varactor-tuned filters over mechanically-tuned filters operating as an evanescent-mode waveguide filter is the simple relationship between frequency and voltage. The passband center frequency of the filter utilizing a varactor varies inversely with the capacitance of the varactor junction. This simple inverse relationship is an advance over the prior art, in which the effective size of the capacitive screws, as seen by the wavefront, varies nonlinearly with frequency. Monolithic microwave integrated circuits are available to linearize the frequency/capacitance relationship, further simplifying the filter's construction and operation.

Not only does the center frequency of the filter vary with capacitance, but the bandwidth remains substantially constant. In other words, the passband of the filter moves with varactor capacitance, so the width of the passband remains substantially constant. As stated above, other designs found in the prior art often reduce bandwidth as the frequency increases. Furthermore, the suppression of a varactor tuned filter outside the passband is on the order of −70 dB. This suppression is of great advantage, especially in a congested area of the spectrum or in areas of high interference. Also, insertion or return losses are held to acceptable levels, without sacrificing simplicity.

BRIEF DESCRIPTION OF THE DRAWINGS

For a more complete understanding of the present invention and the advantages thereof, reference is now made to the following Detailed Description, taken in conjunction with the accompanying Drawings in which.

DETAILED DESCRIPTION OF THE DRAWINGS

Figure 1A:
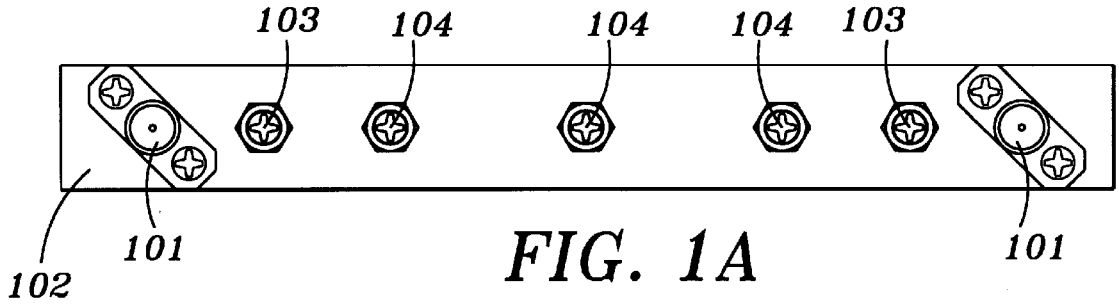
FIG. 1A is a mechanical layout of a bottom view of one embodiment of the waveguide filter of the present invention.
Figure 1B:
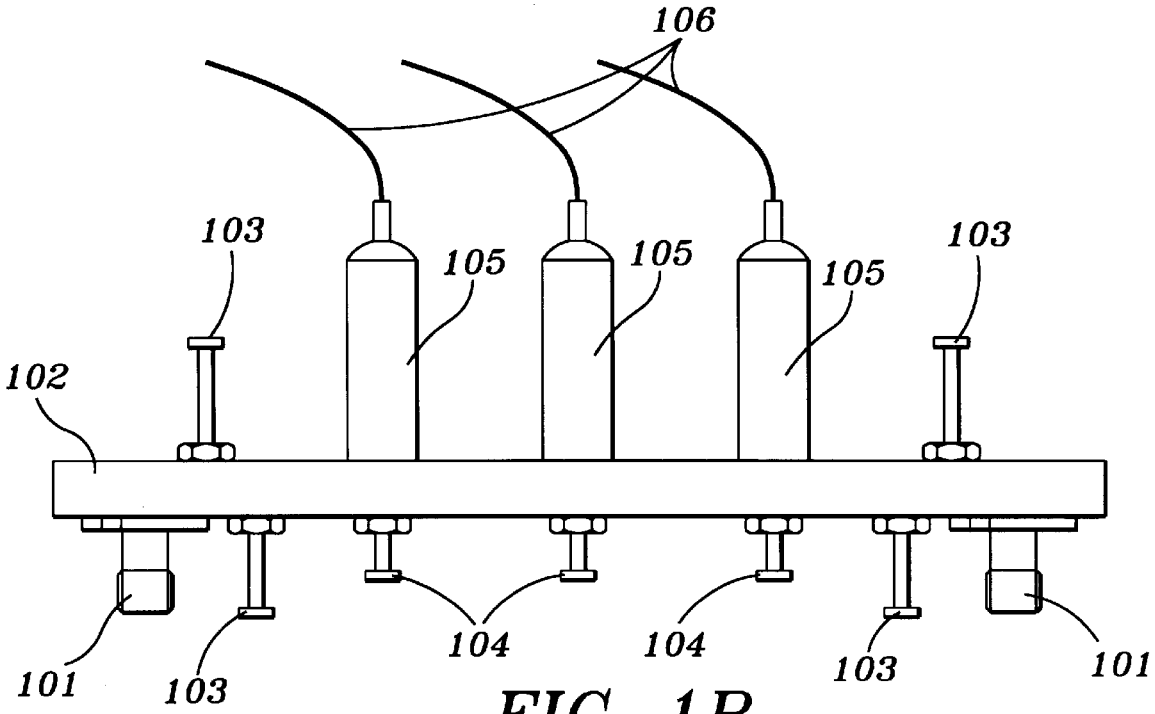
FIG. 1B is a side view of the waveguide filter of FIG. 1A.
Figure 1C:
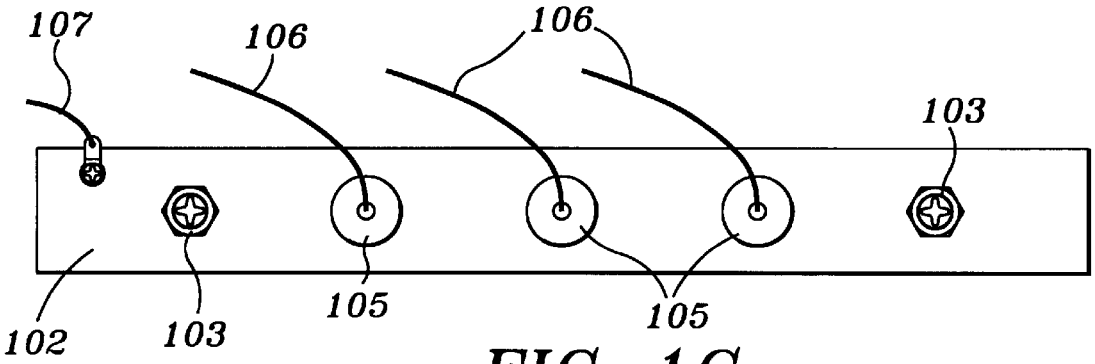
FIG. 1C is a top view of the waveguide filter of FIG. 1A.

Referring now to FIGS. 1A, 1B and 1C and FIG. 2 there is shown a mechanical layout of one embodiment of the varactor-tuned evanescent-mode waveguide filter of the present invention. An input signal is applied to the filter on an SMA connector 101 and an electromagnetic wave propagates down the length of a grounded waveguide 102. The electromagnetic wave propagates down the waveguide 102 past a plurality of tuning screws 103, some of which may be mechanically adjustable; and resonators 105 with coarse tuning screws 104, (shown more fully in FIG. 2) each containing a varactor 203. The coarse tuning screws 104 and the shunt capacitance of the resonators 105 change the attenuation properties of the waveguide 102, and filter the signal applied to the SMA connector 101 to a passband related to a variable bias voltage applied to the resonators 105 thereby providing a variable bias voltage to the varactors 203. In one embodiment of the invention, the variable bias voltages are applied to varactors 203 by means of coaxial-taps via a wire 106 with baseline tuning accomplished by mechanically adjusting the tuning screws 104. The tuning screws 104 also provide the return ground for the varactor 203 having the variable bias voltage applied to the bias terminal.

Figure 2:
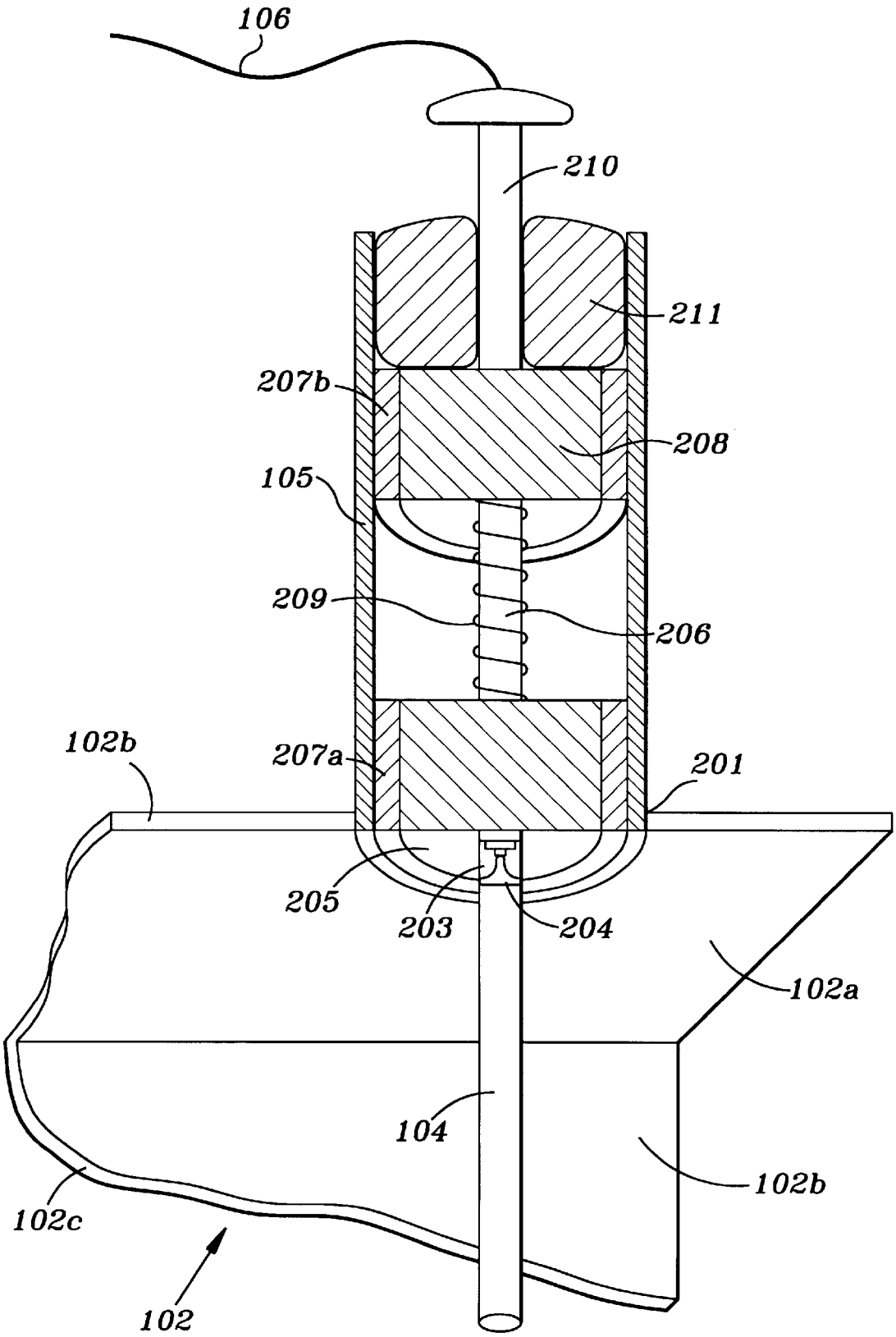
FIG. 2 is a cross-section of a resonator and coaxial tap for the waveguide filter of FIG. 1A.

Referring now to FIG. 2, there is shown a cross-section of the waveguide 102 through the center of a resonator 105 including a varactor 203. The resonator 105 is implemented as a coaxial-tap that includes brass cylinders 205 and 208 interconnected by a copper wire 209. A surface of the brass cylinder 205 represents a coaxial-tap connected to the varactor 203; and also provides a path for the application of an adjustable bias voltage for the varactor from the wire 106. The brass cylinder 208 is positioned with respect to the brass cylinder 205 by means of a Nylon screw 206. The Nylon screw 206 is a structure that provides mechanical support between the brass cylinders 205 and 208 and provides a form for winding the copper wire 209. The copper wire 209 is soldered at an end of each of the brass cylinders 205 and 208. A thin layer of teflon 207*a* and 207*b* functions as a dielectric insulator between the cylinders 205, 208 and an outer conductor of the resonator 105 and forms the inner lining of the outer conductor. This structure forms a coaxial capacitance that functions as a RF short circuit inside the waveguide 102 at the interface of the varactor 203 and the coaxial tap. A coaxial-tap screw 210 is connected from the brass cylinder 208 and to the wire 106; and provides the path for the adjustable bias voltage. The resonator 105 further includes a rubber grommet 211 to hold the coaxial-tap screw 210 in adjustment and also provides a means for holding components of the resonator 105 in place during the coarse capacitance adjustment of the brass tuning screw 104. The components of the resonator 105 provides a structural low pass filter enabling application of a variable bias voltage to the varactor 203. The structure also provides attenuation of the RF signal from the varactor 203 to the wire 106. The resonator 105 also provides coarse mechanical tuning via the tuning screw 104 by the vertical positioning (vertical is defined as movement perpendicular to the waveguide floor) of the brass cylinders 205 and 208 into the inside of the waveguide 102. A change in capacitance occurs due to the change in the surface area between brass cylinder 205 and the cylinder wall (outer conductor) of the resonator 105. Another contribution to the change in capacitance results from the vertical movement of the varactor 203 in the waveguide 102. Coarse tuning of overall capacitance is adjusted as a first step to tuning. Subsequent tuning is then performed via the adjustable bias voltage applied to the varactor 203.

To implement the coaxial tap, a second conductor, for example, the brass tuning screw 104, is threaded into the floor of the waveguide 102. The brass tuning screw 104 connects to the outer conductor of the resonator 105 through the waveguide walls. The outer conductor, soldered at 201 to the exterior of the waveguide 102. Thus, the brass tuning screw 104, the floor of the waveguide 102, and resonator 105 are electrically connected together.

The varactor 203 is mounted to be in contact with an end of 204 of the brass tuning screw 104 and also in contact with the brass cylinder 205. Thus, the voltage differential between the brass tuning screw 104 and the brass cylinder 205 produces a capacitance across the varactor 203 as measured between the brass cylinder 205 and the outer conductor of the resonator 105. The thin teflon insulator 207*a* provides a dielectric for the capacitive electric field.

The brass screw 210 is connected through the lead 106 to a control system (to be described). The lead 106 is connected to the control system (shown in FIG. 3) that supplies a computer-generated voltage control signal to adjust the capacitance of the varactor 203 between the inner and outer conductors of a coaxial tap. A voltage related to the desired tuning frequency is applied to the varactor 203 through the wire 106 and the brass screw 210. This voltage creates a reverse-bias in the varactor 203, creating a capacitance effect across the teflon insulator 207*a*, thereby shunting the waveguide 102. The capacitance is dependent on the voltage supplied on the wire 106, thereby enabling the control system to manipulate the shunt tuning capacitance.

Figure 3:
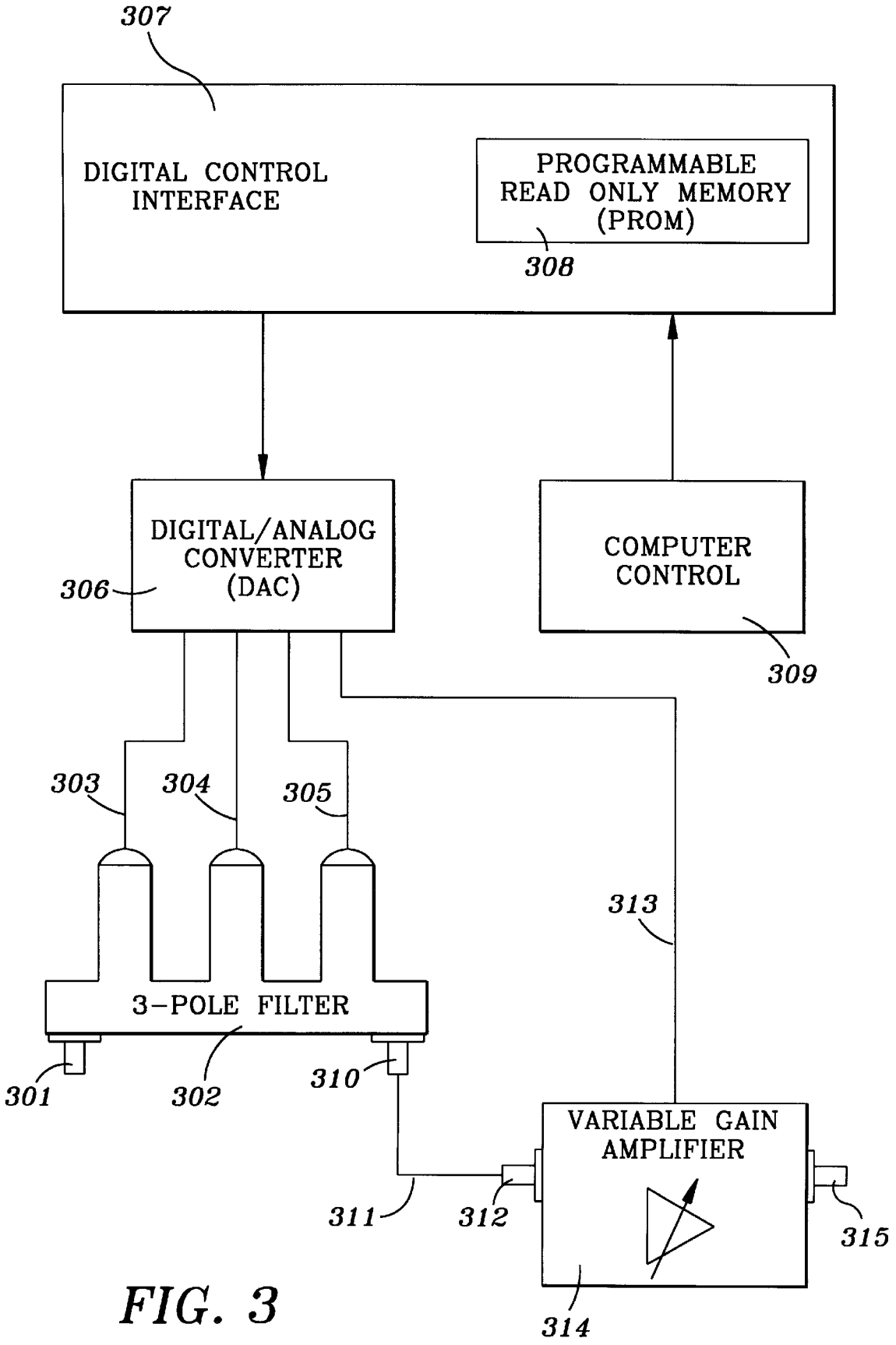
FIG. 3 is a diagram of one embodiment of the waveguide filter of the present invention.

Referring now to FIG. 3, there is shown a diagram of a control system for generating the computer generated control signal for the waveguide filter of the present invention.

FIG. 3 includes a temperature and frequency compensated 3-pole evanescent mode hopping filter 302 connected to a variable gain amplifier 314 for amplitude compensation. As shown, this embodiment is used to replace existing YIG filters or in combination with multiple evanescent mode hopping filter circuits connected in series to produce increased bandpass response filter selectivity.

The RF signal incident on the RF connector 301 is passed into the 3-pole evanescent mode hopping filter 302; where 3-pole signifies that three separate varactor diodes 203 are used. Multiplicity of varactors 203 may be used in other embodiments of a filter in accordance with this invention in which case the filter would be referred to as n-pole evanescent mode hopping filter. An adjustable voltage is supplied to resonators (e.g. resonator 105) of the filter 302 via wires 303, 304, and 305. A digital-to-analog converter (DAC) 306 generates the separate adjustable bias voltages that are applied to the resonators by means of the wires 303, 304, and 305. The digital-to-analog converter (DAC) 306 is controlled via a digital control interface 307. The digital control interface reads temperature, frequency, and amplitude compensation data from the programmable read only memory (PROM) 308 and transfers the information to the digital-to-analog converter (DAC) 306). The digital control interface 307 also receives a frequency command from the computer 309 and in response thereto the digital-to-analog converter (DAC) 306 applies the adjustable bias voltages to varactor 203 that electronically tune (hop) the RF center frequency of the filter 302 to a new frequency location thereby modifying the filter frequency response. The RF signal passes out of the RF connector 310 and into the coaxial cable 311. An input RF connector 312 transfers the RF signal to the variable gain amplifier 314. A temperature compensated control voltage applied to a wire 313 via the digital to analog converter (DAC) 306 is also applied to the variable gain amplifier 314. The amplitude frequency dependence of the RF signal is thereby compensated for each hop frequency generated by the frequency command from the computer 309. A temperature, frequency, and amplitude compensated RF signal is output at a RF connector 315.

Although a preferred embodiment of the present invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

What is claimed is:

1. A controllable evanescent mode frequency hopping filter, comprising:

a waveguide;

a controllable voltage source responsive to a frequency command and having a control output signal;

a coaxial capacitance resonator mounted to the waveguide, said resonator comprising:

a housing mounted to the waveguide and having an opening thereto;

a varactor supported in the housing at the opening thereof, the varactor having a first terminal connected to receive the control output signal; and a mechanically adjustable tuning screw inserted into the waveguide for base line tuning, the tuning screw in contact with a second terminal of the varactor to provide a return ground to the controllable voltage source.

2. The controllable evanescent mode frequency hopping filter as set forth in claim 1 further including one or more additional coaxial capacitance resonators mounted to the waveguide, each of said one or more additional coaxial capacitance resonators comprising:

a housing mounted to the waveguide and having an opening thereto;

a varactor supported in the housing at the opening thereof, the varactor having a first terminal connected to receive the control output signal; and one or more mechanically adjustable tuning screws in number equal to the number of coaxial capacitance resonators, each adjustable tuning screw inserted into the waveguide for base line tuning, each tuning screw in contact with the respective second terminal of the varactor diode to provide a return ground to the controllable voltage source.

3. The evanescent mode frequency hopping filter as set forth in claim 1, further comprising at least one additional mechanically adjustable tuning screw inserted into the waveguide.

4. The evanescent mode frequency hopping filter as set forth in claim 1, wherein said resonator further comprises:

a first cylinder connected to one terminal of the varactor;

a wire connected at one end to the first cylinder;

a second cylinder connected to a second end of the wire;

an adjustable screw connected to the second cylinder for positioning thereof;

said housing supporting the first and second cylinders, electrically separated from the first cylinder and the second cylinder, said housing having an electrical connection to the surface of the waveguide; and a dielectric material, positioned between the housing and the first cylinder and the second cylinder.

5. The evanescent mode frequency hopping filter as set forth in claim 4 further comprising at least one additional tuning screw inserted into the waveguide.

6. A controllable evanescent mode frequency hopping filter, comprising:

a waveguide;

a coaxial capacitance resonator mounted to the waveguide, said resonator comprising:

a housing mounted to the waveguide and having an opening thereto;

a varactor supported in the housing at the opening thereof, the varactor having a first terminal responsive to a control voltage to adjust the capacitance across the depletion region of the varactor to provide a shunt capacitance to the waveguide; and a mechanically adjustable tuning screw inserted into the waveguide for base line tuning, the tuning screw further providing a return ground;

a controller responsive to a frequency command for generating the control voltage to the varactor.

7. The controllable evanescent mode frequency hopping filter as set forth in claim 6 further including one or more additional coaxial capacitance resonators mounted to the waveguide, each of said one or more additional coaxial capacitance resonators comprising:

a housing mounted to the waveguide and having an opening thereto;

a varactor supported in the housing at the opening thereof, the varactor having a first terminal responsive to a control voltage to adjust the capacitance across the depletion region of the varactor to provide a shunt capacitance to the waveguide; and one or more mechanically adjustable tuning screws in number equal to the number of coaxial capacitance resonators, each adjustable tuning screw inserted into the waveguide for base line tuning, each tuning screw in contact with the respective second terminal of the varactor diode to provide a return ground.

8. An evanescent mode frequency hopping filter as set forth in claim 6 wherein said controller further comprises:

a computer control generating at an output thereof the frequency command;

a digital control interface responsive to the frequency command for generating a digital output representative of the control voltage;

a digital-to-analog converter responsive to the output of the digital control interface for generating the control voltage to the varactor.

9. An evanescent mode frequency hopping filter as set forth in claim 6 further comprising:

a first RF connector mounted to an input end of said waveguide;

a second RF connector mounted to the output end of said waveguide;

a variable gain amplifier coupled to the second RF connector, said variable gain amplifier having an RF output signal; and said controller generating a command voltage applied to the variable gain amplifier for temperature compensating the RF signal output from said amplifier.

10. An evanescent mode frequency hopping filter as set forth in claim 9, further comprising:

a memory for storing temperature, frequency and amplitude compensation data for a said waveguide;

an analog-to-digital converter responsive to the temperature, frequency and amplitude compensation data to generate the control voltage to said variable gain amplifier that varies in accordance with the compensation data, the RF signal output of said amplifier compensated for temperature, frequency and amplitude.

11. An evanescent mode frequency hopping filter as set forth in claim 8, wherein said resonator further comprises:

a first cylinder connected to one terminal of the varactor;

a wire connected at one end of the first cylinder;

a second cylinder connected to a second end of the wire;

an adjustable screw connected to the second cylinder for positioning thereof;

said housing supporting the first and second cylinders, electrically separated from the first cylinder and the second cylinder, said housing having an electrical connection to the surface of the waveguide; and a dielectric material, positioned between the housing and the first cylinder and the second cylinder.

12. The evanescent mode frequency hopping filter as set forth in claim 11 further comprising at least one additional tuning screw inserted into the waveguide.

13. An evanescent mode frequency hopping filter, comprising:

a waveguide;

an adjustable tuning screw inserted into the waveguide; and at least one resonator mounted to the waveguide, said at least one resonator comprising a varactor responsive to a control voltage to adjust the capacitance across the depletion region of the varactor to provide a shunt capacitance to the waveguide, a first cylinder connected to one terminal of the varactor, a wire connected to one end of the first cylinder, a second cylinder connected to a second end of the wire, an adjustable screw connected to the second cylinder for positioning thereof, an outer conductor supporting the first and second cylinders, electrically separated from the first cylinder and the second cylinder, said outer conductor having an electrical connection to the surface of the waveguide, and a dielectric material, positioned between the outer conductor and the first cylinder and the second cylinder.

* * * * *